United States Patent [19]

Kinkaid et al.

[11] 4,082,402

[45] Apr. 4, 1978

[54] FLAT FLEXIBLE CABLE TERMINAL AND ELECTRICAL CONNECTION

[75] Inventors: Robert John Kinkaid, New Cumberland; John Carl Asick, Harrisburg, both of Pa.

[73] Assignee: AMP Incorporated, Harrisburg, Pa.

[21] Appl. No.: 539,128

[22] Filed: Jan. 6, 1975

Related U.S. Application Data

[63] Continuation-in-part of Ser. No. 432,112, Jan. 9, 1974, abandoned.

[51] Int. Cl.[2] ..... H01R 11/20

[52] U.S. Cl. ..... 339/97 C; 339/276 T

[58] Field of Search ..... 339/17 F, 97–99, 339/176 MF, 276

[56] References Cited

U.S. PATENT DOCUMENTS

| | | | |
|---|---|---|---|
| 2,302,767 | 11/1942 | Hackbarth | 339/97 C |
| 3,395,381 | 7/1968 | Huffnagle | 339/97 C |
| 3,713,072 | 1/1973 | Henschen et al. | 339/17 F |
| 4,012,101 | 3/1977 | Damoisiaux et al. | 339/97 C |

*Primary Examiner*—Joseph H. McGlynn

*Attorney, Agent, or Firm*—Gerald K. Kita; Russell J. Egan

[57] ABSTRACT

The present invention relates to a terminal intended for crimped electrical connection to a conductor of flat configuration encased within an insulation sheath or jacket. The terminals is specifically suitable for penetrating through the insulation jacket and for encircling the conductor to establish a mechanical and electrical connection therewith. The terminal is provided with opposed pairs of sharpened teeth which are intended to be crimped or bent in curled relationship over the side margins of the flat configuration conductor, inwardly deforming or pinching the conductor side margins at a plurality of locations. The edges of the teeth are sharpened to insure penetration of the teeth through the insulation jacket to establish the desired electrical connection with the inwardly crimped portion of the conductor. The terminal teeth define clearances therebetween into which portions of the conductor side margins are forcibly wedged. The edges of the teeth adjacent the clearances are sharp to slice through the insulation jacket and electrically contact the conductor. The tips of the teeth are curled toward the conductor and press the conductor against a web portion of the terminal and also to flatten the conductor against the web portion of the terminal and forcibly wedge the side margins of the terminal into the clearances between the side margins of the terminals into the clearances between the adjacent teeth. By inwardly pinching the conductor side margins with the terminal teeth and by wedging additional portions of the side margins into the teeth surfaces of adjacent teeth, the terminal may be crimped in encircling relationship on a conductor, applying sufficient pressure to maintain good electrical contact between the terminal and conductor.

11 Claims, 13 Drawing Figures

FLAT FLEXIBLE CABLE TERMINAL AND ELECTRICAL CONNECTION

CROSS REFERENCE TO COPENDING APPLICATION

This is a continuation-in-part application of application Ser. No. 432,112, filed Jan. 9, 1974, and now abandoned.

BACKGROUND OF THE PRIOR ART

There has been a long existing need in the prior art to provide an electrical terminal suited for electrical connection to a flat conductor. In accordance with established practice in the prior art, a plurality of flat configuration conductors extend longitudinally in parallel relationship within an insulation sheath or jacket which is laminated and bonded to the conductors, completely encasing each individual conductor within a sheath or jacket of insulation and rigidly locating the individual conductors in precise side-by-side orientation. There have been many attempts to electrically terminate terminals to each individual flat conductor of the transmission cable exemplary one of which is described in U.S. Pat. No. 3,703,604. According to one technique, the insulation sheath is removed by etching or stripping away to expose the individual conductors. Terminals are then soldered or crimped onto the individual conductors. This procedure is not successful, since hand labor is required for stripping away the insulation. The procedure is thus not suited for automatic connection of electrical terminals. According to another technique, the individual conductors are forcibly inserted into slotted plate type terminals. This technique has the advantage in that slotted plate terminals slice through the insulation jacket and electrically contact the individual conductors without a need for removing the insulation. The disadvantage of this technique is that the slotted plate terminals require a housing to hold the individual conductors within the slotted plate terminals. Also the slicing type connection weakens the mechanical gripping force of the terminals on the individual conductors, necessitating a separate clamping fixture to grip the conductors connected to the slotted plate terminals. Further, the slotted plate terminals are of necessity much wider than the width of the individual conductors, preventing use of such terminals when the conductors are closely spaced in the insulation jacket.

According to another technique of the prior art, channel shaped terminals were developed which straddle the conductors, and which penetrate through the insulation jacket, permitting the sides of the channel shaped terminals to be curled in collapsed relationship over the conductors.

Such a technique has the advantage that no cutting away of the insulation sheath is required. A plurality of terminals may be crimped to conductors which are closely spaced, since the terminals are curled in intimate contact over the periphery of the conductors. One disadvantage in the technique of the prior art, is that a desired electrical connection to the conductors could be accomplished only if the terminal were collapsed tightly over the conductor. If the thickness of the conductor or of the insulation sheath varied, the collapsed terminal would only loosely engage the conductor. More specifically, if the conductor and sheath thicknesses were too thin, the terminal would be insufficiently collapsed to successfully grip onto the conductor. In a case where the conductor or sheath thickness were too thick, the terminal could not be compressed with a sufficient force to collapse tightly over the conductor. Accordingly the terminal of the prior art is dependent upon the relative thicknesses of the conductor and insulation to provide the desired electrical connection on the conductor. It was heretofore thought that the terminal of the prior art should be fabricated from relatively thick material to allow coining of the terminal when crimped to a flat conductor. The coining operation struck out projections which were used to force penetrating lance portions of the terminal into engagement with the conductors. The penetrating lance portions provided the desired electrical connection, and the coined projections prevented the lance portions from disengaging from the conductors. The disadvantage in utilizing a relatively thick material for the terminals, is that relatively high crimping forces are required to collapse the terminal around the conductor and to create the coined portions of the terminal during crimping. Accordingly, a plurality of such terminals were applied sequentially one at a time. The required high crimping forces prevented application of a plurality of terminals simultaneously. Accordingly, even when machines applied, a plurality of terminals crimped sequentially required a large expenditure of time.

BRIEF DESCRIPTION OF THE INVENTION

The present invention relates to an electrical terminal intended for crimped electrical connection to a conductor of flat configuration encased within an insulation sheath or jacket. The terminal is specifically suitable for penetrating through the insulation jacket and for encircling in crimped relationship over the conductor to establish a mechanical and electrical connection therewith. The terminal is provided with opposed pairs of sharpened teeth which project from a web of the terminal. To establish the desired electrical connection, the flat configuration conductor is forcibly inserted between the opposed pairs of sharpened teeth. Initially the opposed pairs of teeth are spaced apart a distance less than the width of the conductor. Thus upon forcible insertion of the conductor between the opposed pairs of teeth, the teeth must inwardly deform or pinch the side margins of the conductor to allow passage of the teeth past the conductor side margins. The opposed pairs of teeth thereby straddle the conductor side margins, inwardly pinching the side margins at a plurality of locations. The edges of the teeth are sharpened to insure penetration of the teeth through the insulation jacket to establish the desired electrical connection with the inwardly deformed portions of the conductor side margins. The terminal teeth are purposely of triangular shape such that adjacent terminal teeth define therebetween a converging tapered clearance. As a conductor is forcibly inserted between the opposed pairs of teeth, the side margins of the conductor will be progressively gathered into the tapered clearances between adjacent teeth. Subsequent to insertion of the conductor between the opposed pairs of teeth, crimping dies deform the teeth in curled relationship, first toward each other, and then, toward the web, to pinch the conductor against the web and further to press the conductor toward the web in a direction such that its gathered side margins are forcibly wedged between adjacent teeth. The edges of the teeth are sharpened so as to penetrate through the insulation jacket and to establish an electrical connection with the gathered portions of the conductor side margins. The tips of the teeth are curled toward the conductor and penetrate the insulation sheath to establish electrical connection with the conductor.

According to the present invention, an electrical terminal is provided with a plurality of teeth having sharpened edges which are utilized to pierce through the insulation jacket of a flat conductor cable. The teeth initially are spaced apart a distance of less than the width of the flat conductor, such that when the conductor is forcibly inserted between the teeth, the conductor side margins are inwardly pinched or deformed by the teeth. The teeth sharpened edges penetrate through the insulation sheath to establish multiple points of electrical contact with the inwardly pinched or deformed side margins of the conductor. Subsequently the teeth are deformed and curled in encircling relationship over the conductor, the teeth being inwardly curled to penetrate the insulation jacket and establish an electrical connection with the conductor. The gripping pressure of the teeth in encirclement over the conductor, presses the conductor side margins against the teeth, and wedges additional side margin portions wedgingly between adjacent teeth.

According to the present invention the gripping pressure of the terminal over the conductor is created substantially as the result of inwardly pinching the side margins of the conductor and wedging additional portions of the side margins of the conductor into the sharpened surfaces of the terminal teeth. The internal crimping pressure of the terminal over the conductor is therefore less dependent upon the relative thicknesses of the conductor and the insulation sheath. Additionally the gripping pressure is less dependent upon the amount of collapse required of a terminal to pinch the conductor against the terminal web portion. By inwardly pinching the conductor side margins with sharpened teeth and by wedging additional portions of the side margins into the sharpened teeth, sufficient crimping pressure of the terminal over the conductor is maintained without the requirement for an inordinate collapse of the terminal in pinched relationship on the conductor. Any further advantages are attributed to the present invention, of the inwardly pinched conductor side margins and the side margins of the conductor which are wedged between adjacent teeth established multiple points of electrical contact along the edges of the teeth which penetrate through the insulation jacket. As a further feature of the present invention, the terminal teeth are stamped and formed from relatively thin metal, and are easily deformed and curled upon closure of crimping dies to pinch the conductor against the web portion of the terminal. The force required to close the dies and deform the terminal is thereby reduced, permitting a plurality of terminals to be simultaneously crimped onto individual conductors without a need for excessive forces to effect die closure and to deform the terminal into pinched relationship over the conductors. The mechanical strength of the completed electrical connection is the result of gripping onto the inwardly pinched conductor side margins and therefore does not depend upon the need to coin a portion of the terminal to provide a locking feature preventing opening of the collapsed terminal.

OBJECTS OF THE INVENTION

It is therefore an object of the present invention to provide an electrical terminal intended for crimped electrical connection to a conductor of flat configuration encased within an insulation sheath or jacket, wherein the terminal penetrates the insulation jacket to provide a plurality of points of electrical contact with the conductor.

Another object of the present invention is to provide an electrical terminal intended for crimped electrical connection to a conductor of flat configuration encased within an insulation sheath or jacket, wherein the terminal is provided with a plurality of opposed pairs of sharpened teeth, which are intended to penetrate the insulation sheath and inwardly pinch the conductor side margins at a plurality of locations, with the teeth having sharp edges for penetrating the insulation sheath to establish electrical contact of the terminal with the inwardly pinched side margins of the conductor at a plurality of locations, with additional portions of the side margins gathered between adjacent teeth, such that when the teeth are crimped into curled relationship in encircling relationship over the conductor, the teeth will press the gathered portions of the conductor wedgingly between adjacent teeth, with the teeth surfaces being sufficiently sharp to penetrate the insulation jacket and establish electrical connection with the conductor gathered portions.

It is another object of the present invention to provide an electrical terminal having a plurality of sharpened teeth intended to penetrate through an insulation sheath encasing a flat configuration conductor, with the teeth inwardly pinching the side margins of the conductor and being adapted for curled crimped encirclement over the conductor to firmly anchor the terminal to the conductor, with the terminal teeth having sharpened edges to penetrate through the insulation sheath and establish electrical connection of the terminal to the conductor at a plurality of locations, and with the mechanical strength of the resulting connection being dependent upon the terminal grip on the inwardly pinched portions of the conductor rather than solely upon the collapse of the terminal in encirclement over the thickness of the conductor.

Other objects and many attendant advantages of the present invention will become apparent upon perusal of the following detailed description taken in conjunction with the accompanying drawings, wherein.

Figure 9:
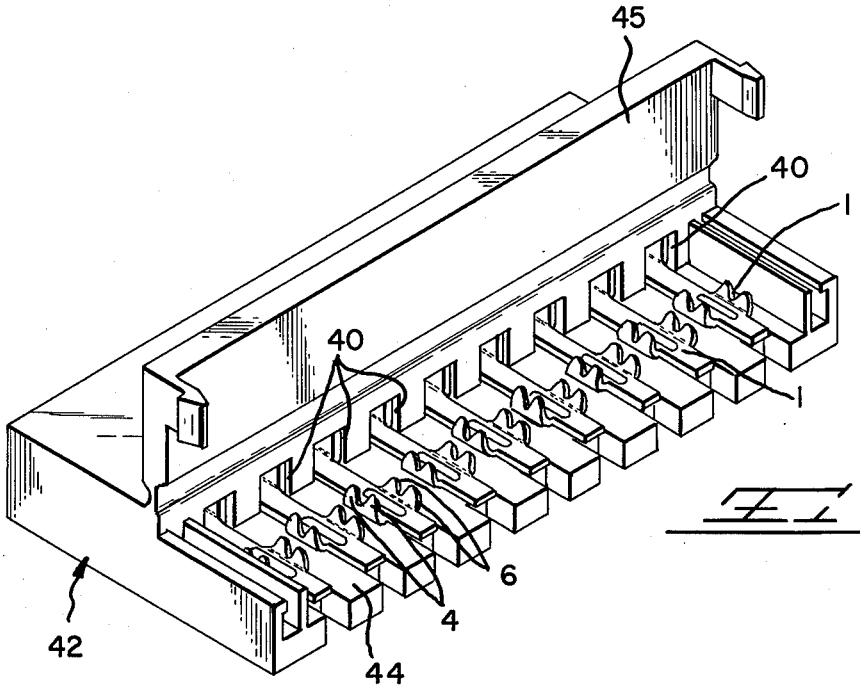
FIG. 9 is a perspective of the terminals of FIG. 8 inserted within the terminal block and with the carrier strip having been removed.
Figure 10:
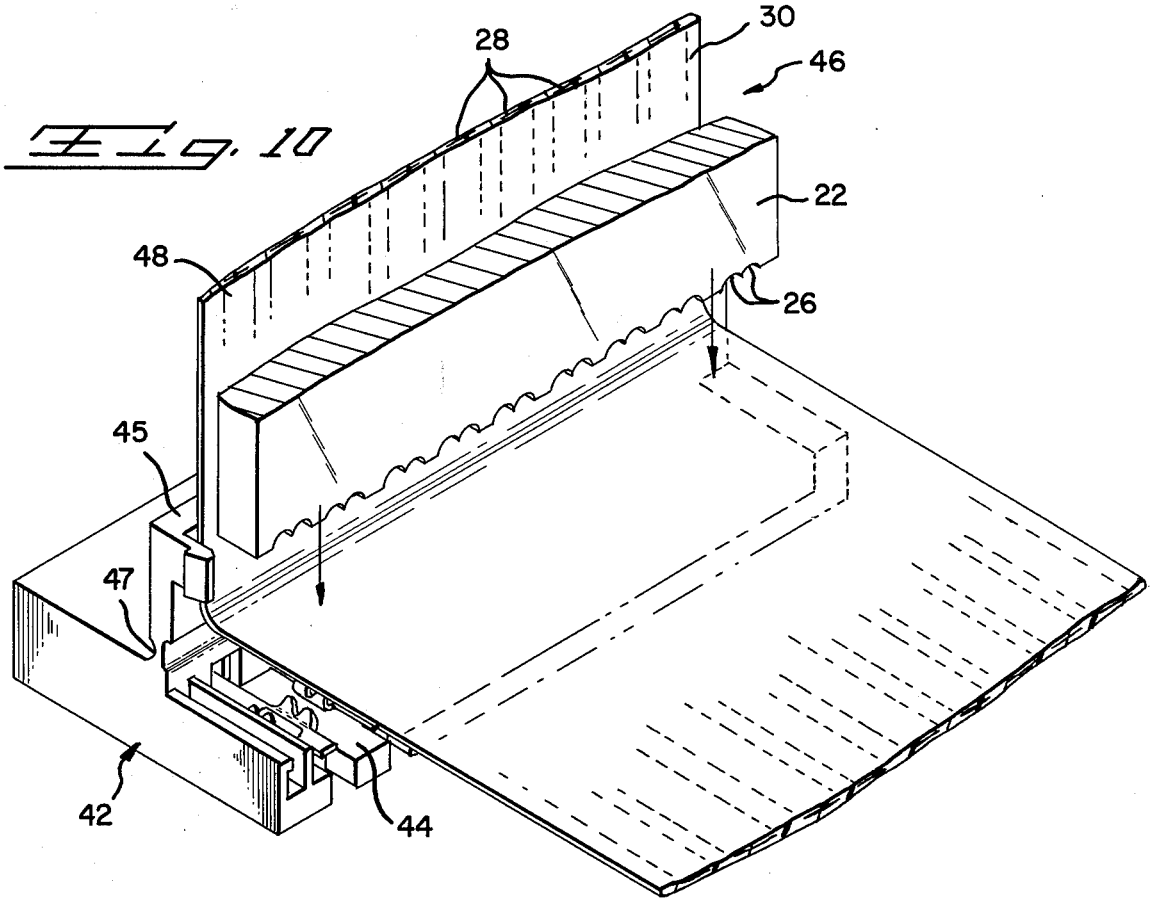
Figure 11:
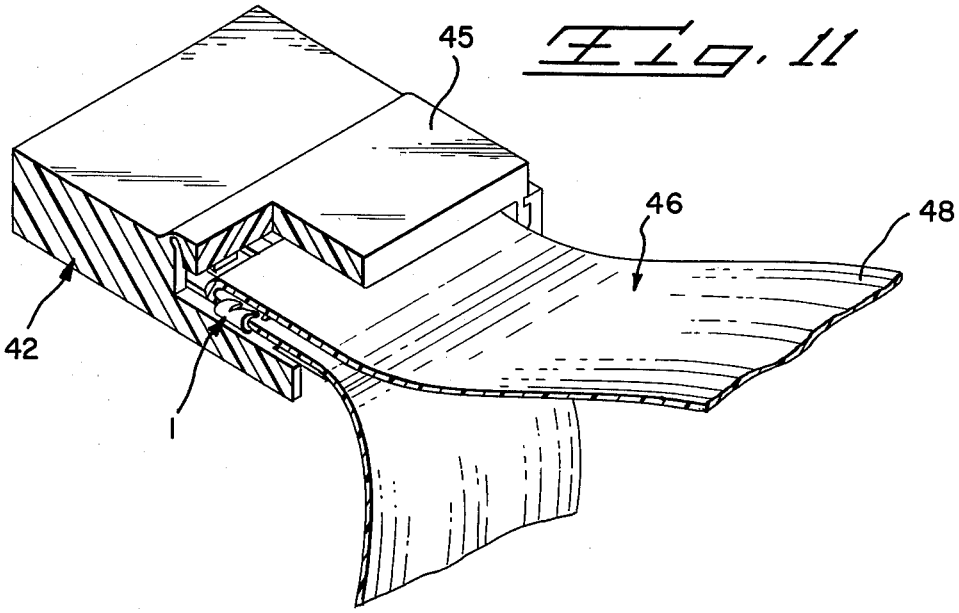

FIG. 10 is a fragmentary perspective illustrating schematically a crimping die and a multiconductor cable having flat configuration conductors overlying the terminals illustrated in FIG. 9, prior to insertion of the conductors within the terminals and prior to crimped connection of the terminals to the conductors; and FIG. 11 is an enlarged fragmentary perspective with parts broken away and in section to illustrate details of the cable crimped to the terminal contained within the housing of insulation material.

Figure 12:
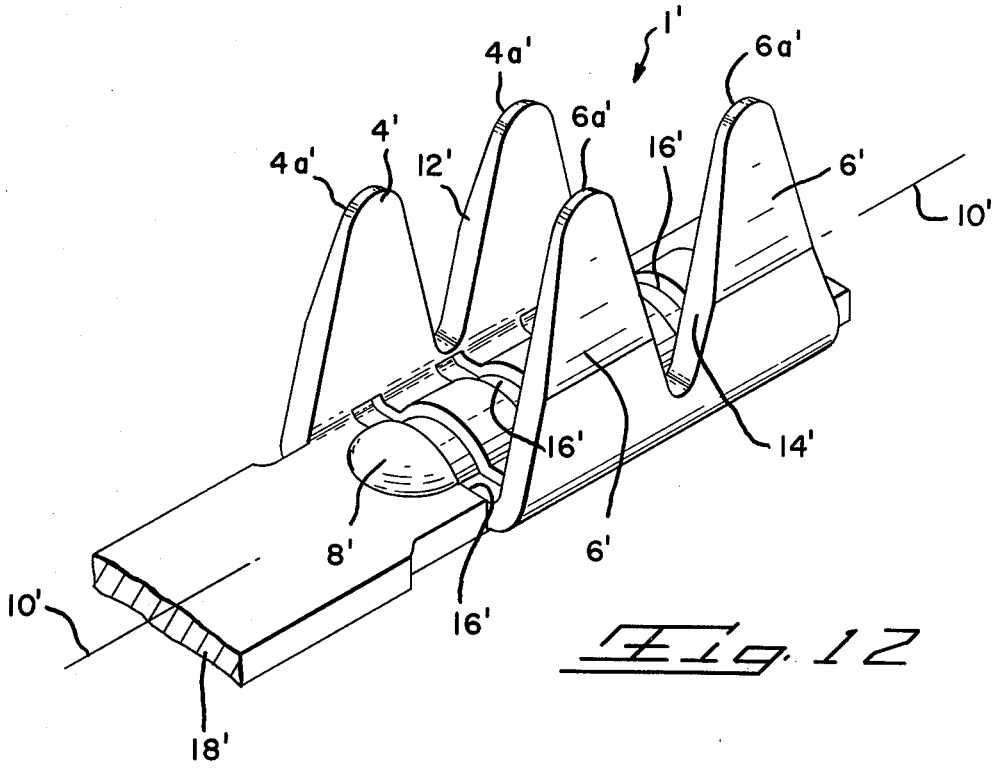

FIG. 12 is a perspective of another preferred embodiment according to the present invention.

Figure 13:
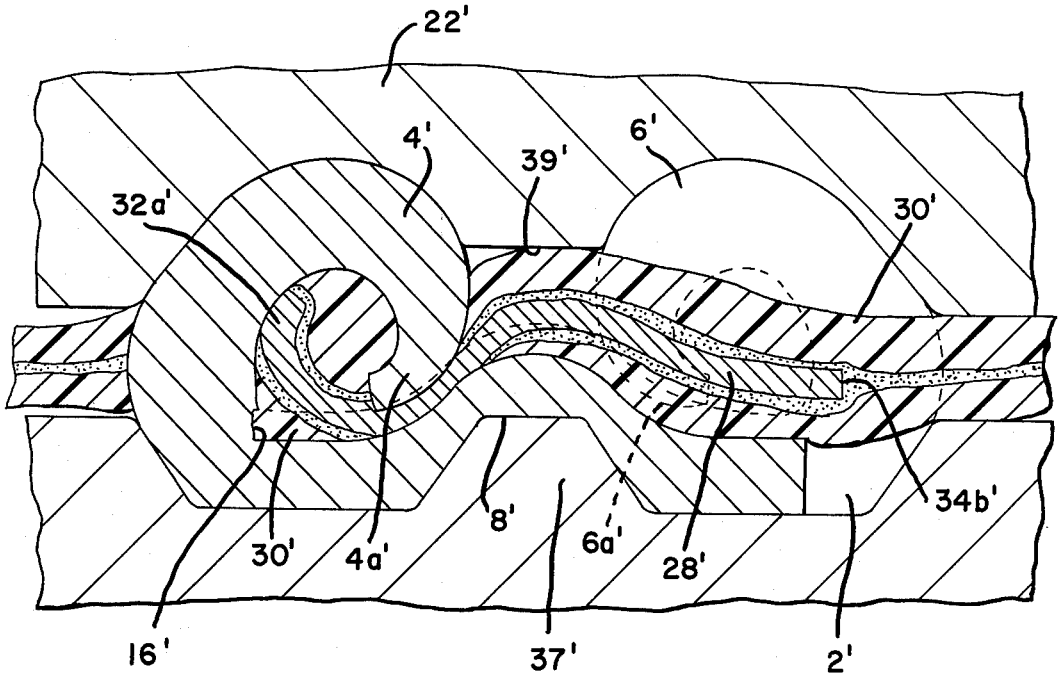

FIG. 13 is a section of a crimped connection utilizing the preferred embodiment as shown in FIG. 12.

With reference to FIGS. 12 and 13 another preferred embodiment of the present invention will be described in detail. Parts which are similar to those of the preferred embodiments shown in FIGS. 1–7 will have like numbers with primed designations. Accordingly an electrical terminal shown generally at 1′ includes a web portion 2′ having a first pair of teeth 4′ and a second pair of teeth 6′ on opposite side edges of the web portion 2. A longitudinally extending channel portion 8′ is raised along the longitudinal axis 10′ of the web portion 2′. The teeth 4′ and 6′ are initially bent outwardly of the web portion 2′ generally parallel to each other and parallel to the longitudinal axis 10′. Tapered clearances 12′ are defined between the adjacent teeth giving the teeth triangular or wedge shaped configurations. The web portion 2′ is provided with a plurality of recessed groove channels 16′ which terminate adjacent the teeth 4′ and 6′ instead of extending partially along the teeth as in the previous embodiment. The teeth tips 4*a*′ and 6*a*′ are chamfered along their outwardly directed surfaces to provide the appearance of chisel-shaped teeth tips. It has been found that by terminating the channel 16 adjacent the corresponding teeth 4 or 6 instead of extending them into or along the teeth, the teeth will be stiffer at the base and will not curl into as small a radius of curvature when crimped to an electrical connection as shown in FIG. 13. Also the chamfered tips 4*a* and 6*a*′ of the teeth will curl substantially more than the remainder of the body of the corresponding teeth 4′ and 6′. In other words during the crimping operation, the radius of the curvature progressively decreases from the base of the corresponding teeth to the tips thereof. This permits the teeth tips 4*a* and 6*a*′ to curl into more of a closed loop than the first disclosed embodiment. The teeth tips 4*a* and 6*a*′ will become curled with the outside surfaces tucked against the surface of the raised channel portion 8′. Thus when subjected to heat cycling or relaxation of the crimp the teeth will tend to uncurl; but this will only increase its pressure against the raised channel portion 8′ and will tend to remain in tucked position thereagainst. The conductor 28′ and the insulation 30′ thereof will be gripped and engaged in the same fashion as that disclosed in the previuos embodiment. However since the teeth are curled into a partially tucked position against the channel portion 8′ the terminal more readily maintains the conductor in a pinched position between the teeth tips and the raised portion 8′ of the web 2′. The tendency of the teeth to uncurl in response to heat expansion or resilient relaxation of the crimping forces will only tend to pinch the teeth even more tightly against the raised channel portion of the web portion further enhancing the grip of the terminal on the conductor and preventing any relaxation of the terminal from its pressure engagement mechanically and electrically with the conductor. Penetration of the conductor by the teeth is limited to the relatively sharp tips of the teeth, leaving the remainder of the teeth in curled pinched compression on the conductor and insulation sheath. As shown in FIG. 12, the very point of the sectioned tooth is shown penetrating the conductor, giving the impression that the conductor is severed. However, the conductor is not penetrated by the remainder of the tooth which is outside of the section plane. The conductor is thereby gripped by the portions of the tooth tip which is behind or in front of the section plane through the point of the tooth.

Figure 1:
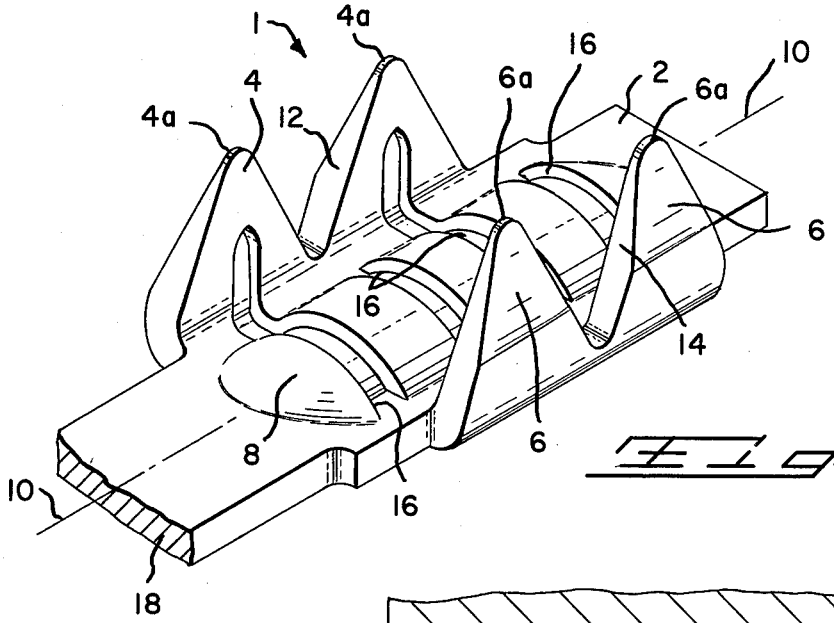
FIG. 1 is an enlarged fragmentary perspective of a preferred embodiment of an electrical terminal according to the present invention.

With more particular reference to the drawings there is shown in FIG. 1 generally at 1 an electrical terminal according to the present invention. The terminal includes a web portion 2 which is substantially planar and elongated. A first pair of teeth 4 unitary with the web portion project from one side edge of the web portion 2, and a second pair of teeth 6 unitary with the web portion 2 project from an opposite side edge of the web portion 2. The web portion 2 is provided with an longitudinally extending dimple portion 8 which provides a raised portion extending along the longitudinal axis 10 of the elongated web portion 2.

Figure 2:
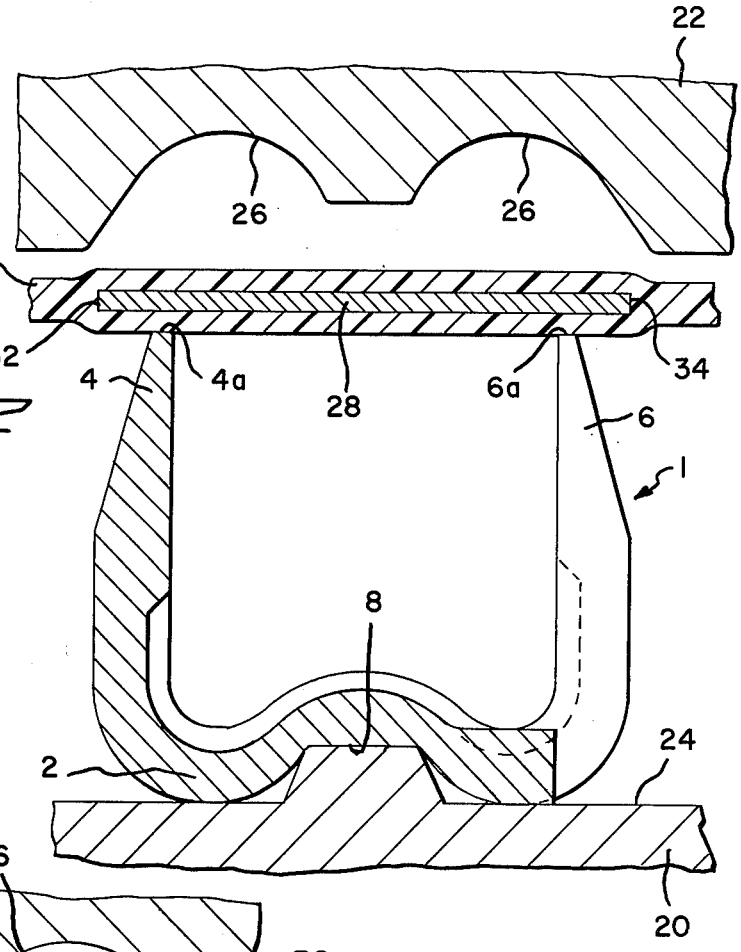
FIG. 2 is an enlarged elevation in section illustrating the terminal according to the preferred embodiment illustrated in FIG. 1 positioned within a pair of forming dies together with an elongated conductor of flat configuration encased within an insulation jacket, the component parts being illustrated in stacked relationship prior to the connection of the terminal to the conductor.

As shown in FIGS. 1 and 2, the first pair of teeth 4 are bent to project initially out of the plane of the web portion 2 and the second pair of teeth 6 are also bent to project initially outwardly of the web portion 2.

The adjacent teeth 4 of the first pair are generally parallel to each other and extend parallel to the longitudinal axis 10. In similar fashion the adjacent teeth of the second pair are initially parallel to each other and parallel to the longitudinal axis 10. Between the adjacent teeth 4 is defined a tapered clearance 12. It is to be noticed that the adjacent teeth 4 are generally of wedged shape or triangular configuration to define the wedge shape of the clearance 12. In similar fashion, the adjacent teeth 6 are triangular or of wedged shape configuration to define therebetween a clearance 14 which is tapered. Also the teeth 6 are offset longitudinally along the center axis 10 with respect to the teeth 4 for a purpose to be described. The web portion 2 is provided with a plurality of recessed groove channels 16 which extend laterally across the webbed portion and at least partially along the inwardly directed surfaces of the teeth 4 and 6, shown in FIG. 1. The channels 16 are provided for example by coining the surface of the web portion 2 and the inner surfaces of the corresponding teeth 4 and 6 prior to bending the teeth 4 and 6 out of the plane of the web portion and into the positions as shown in FIG. 1. FIG. 1 shows a surface 18 which is broken away and to which is usually provided a terminal contact portion which is formed integral with the web portion 2. It is to be understood that any terminal contact portion desired may be formed with the webbed portion 2. For that reason, no particular terminal contact portion is illustrated in the Figure.

With reference to FIGS. 2, 3, 6 and 7, the sequence by which connection of the terminal 1 to a flat configuration conductor will be described in detail. As shown in FIG. 2 a schematic representation of a pair of dies 20 and 22 are illustrated. The die 20 provides an anvil surface 24 on which the web portion of terminal 1 is initially located, with the teeth 4 and 6 projecting outwardly away from the anvil surface 24. The other die 22 is provided with a pair of arcuate inverted surfaces 26 which intersect each other. The surfaces 26 are intended to engage the teeth 4 and 6 to curl over and collapse the teeth in encirclement over a flat configuration conductor, upon closure of the dies 20 and 22, for example by movement of the dies 20 and 22 toward each other. As shown in FIG. 2 a flat configuration conductor 28 is encased within an outer sheath 30 of insulation material. The insulation material 30 thus provides a jacket or sheath entirely containing the flat configuration conductor 28 therein and locating the conductor in desired orientation within the sheath or jacket. Typically, the conductor 28 is bonded to the jacket or sheath, with any plurality of conductors similar to the conductor 28 being contained within the same jacket but spaced from one another in parallel relationship. Such a plurality of conductors within a common insulation sheath or jacket is known in the prior art as a flat, flexible cable which is generally flat and flexible appearing as a tape or ribbon with a plurality of conductors contained within the jacket of insulation. Thus although only one conductor 28 is illustrated it is to be understood that often a plurality of similar conductors may be contained within a common insulation jacket.

Figure 4:
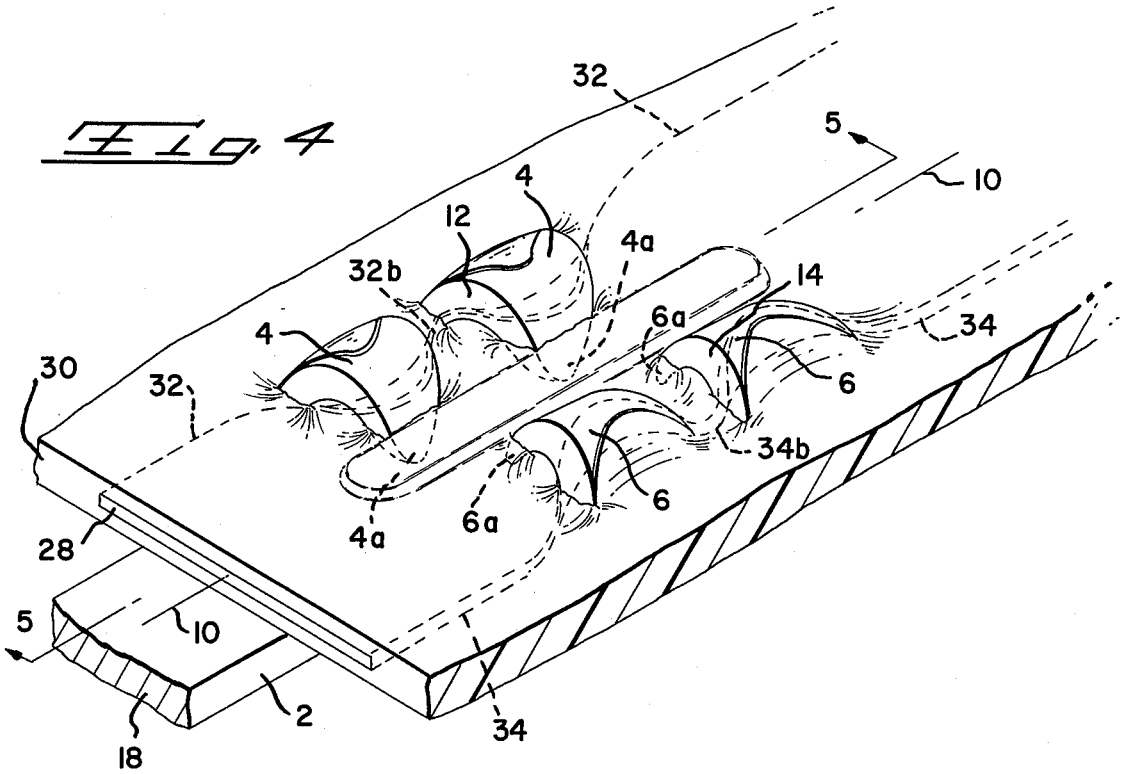
FIG. 4 is an enlarged fragmentary perspective of a completed electrical connection according to the present invention, which connection is formed by closure of the dies as illustrated in FIG. 3.
Figure 7:
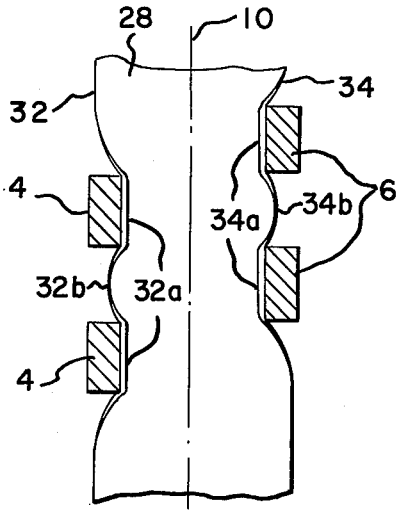
FIG. 7 is an enlarged fragmentary plan view of the component parts illustrated in FIG. 6, illustrating the conductor forcibly inserted into the terminal, and further illustrating the side margins of the conductor being inwardly pinched by portions of the terminal, which portions are in section to illustrate the details thereof.
Figure 8:
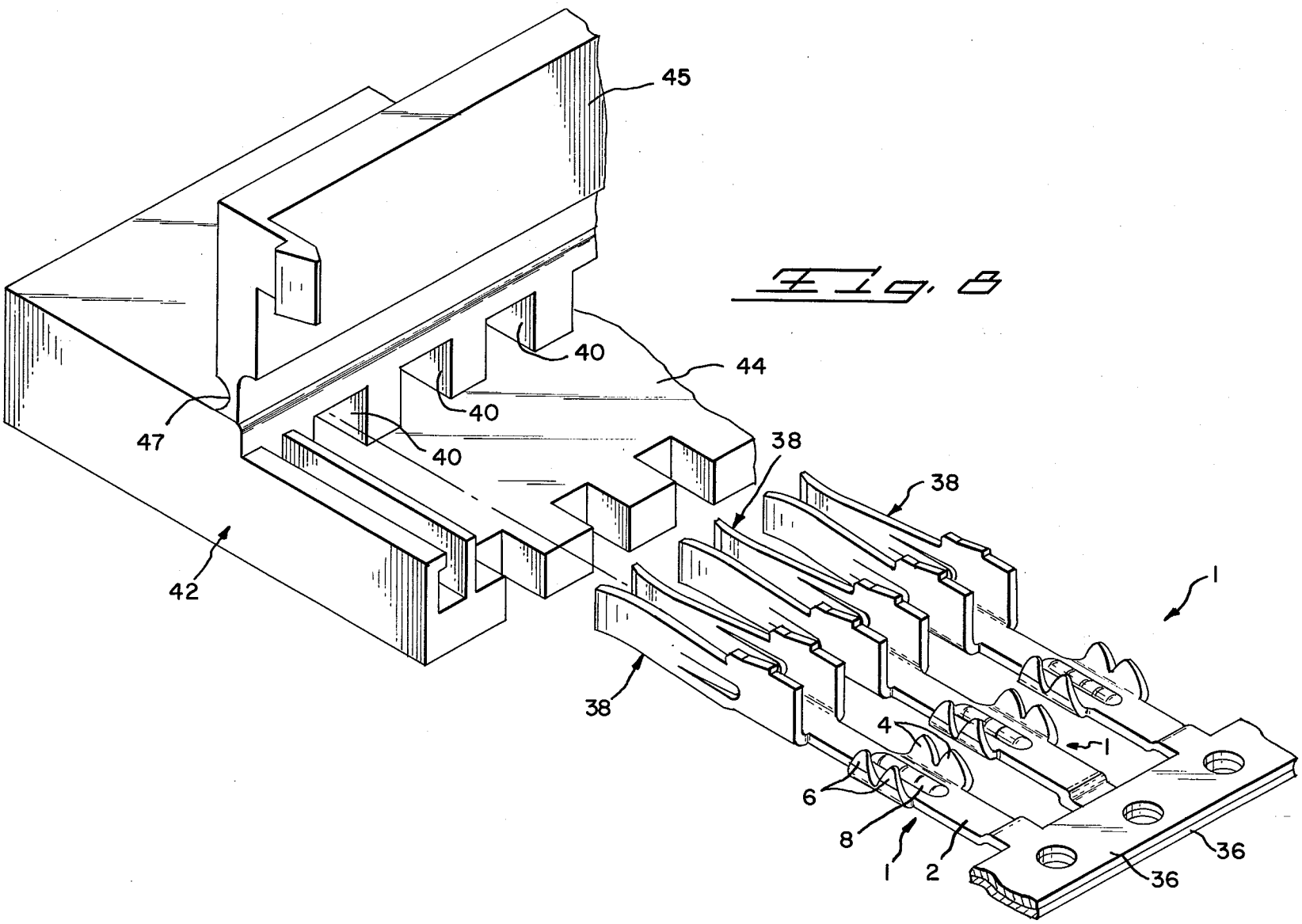
FIG. 8 is an enlarged fragmentary perspective of a plurality of terminals according to the present invention depending from a carrier strip and provided with receptacle type contacts adapted for insertion with corresponding cavities of a connector housing of insulation material.

As shown in FIG. 2, the examplary illustrated conductor 28 is provided with a pair of opposed elongated side margins 32 and 34 which extend entirely along the length of the conductor 28. Prior to connecting the terminal 1 to the conductor 28, the cable, comprised of the insulation jacket 30 and the conductor 28, is located between the pair of spaced dies 20 and 22 in overlying relationship with respect to the terminal as shown in FIG. 2, with the side margins 32 and 34 overlying the teeth tips 32*a* and 34*a*. The space defined between the first pair of teeth 4 and the second pair of teeth 6 is purposely selected to be initially of a distance less than the width of the conductor 28 as defined between the side margins 32 and 34 of the conductor. As shown diagrammatically in FIG. 6, and also in FIG. 2, the side margins 32 and 34 of the conductor 28 overlie the tips 4*a* and 6*a* of the teeth 4 and 6. As the dies 20 and 22 are closed, for example, by moving the die toward each other, the die 22 first will engage the cable and will forcibly insert the conductor 28 into the space between the teeth 4 and 6. More specifically, the teeth tips 4*a* and 6*a* initially engage the insulation jacket and penetrate through the insulation jakcet during insertion of the conductor 28. It was found that using a stock thickness of 0.0010 thickness for the terminal 1, the teeth tips 4*a* and 6*a* may be provided with a radius of 0.005 of an inch which is an ideal dimension to allow penetration of the teeth tips through the insulation jacket, while at the same time preventing penetration of the teeth tips into the conductor 28 which is generally of copper which is more resistant to penetration of the teeth than the insulation jacket. Upon insertion of the conductor 28 into the space between the pairs of teeth 4 and 6, the teeth tips 4*a* and 6*a* will penetrate through the insulation jacket 30 but not through the conductor 28. As shown in FIG. 7, the side margins 32 and 34 of the conductor must be inwardly deformed as by pinching inwardly toward the center line 10 of the conductor 28 to allow passage of the conductor into the space between the pairs of teeth 4 and 6. Thus as shown in FIGS. 7 and 4, the side margins 32 and 34 are inwardly deformed with portions 32*a* and 34*a* immediately adjacent the teeth 4 and 6, whereas additional portions 32*b* and 34*b* of the conductor side margins are not inwardly deformed. This can be explained due to the fact that the conductor 28 is made of copper which has sufficient inherent resiliency to resist deformation inwardly. Therefore the copper attempts to spring back resiliently to form portions 32*b* and 34*b*. In addition, the insulation jacket or sheath is also inherently resilient and resists deformation inwardly toward the center line 10 of the conductor. This also contributes to the outwardly bowed configurations 32*b* and 34*b*. Inwardly deformed or pinched portions 32*a* and 34*a* of the conductor side margins are therefore considerably localized immediately adjacent to the teeth 4 and 6. Thus the teeth positively grip the conductor side margins inwardly pinching or deforming the same at the localized portions 32*a* and 34*a*. The portions 32*b* and 34*b* of the conductor side margins are gathered into the corresponding clearances 14 and 12 between the adjacent teeth as the teeth penetrate through the insulation jacket. More particularly, the teeth are of tapered or wedged shape configuration, such that, as the conductor 28 is forcibly inserted into the confines of the terminal, the teeth tips 4*a* and 6*a* initially penetrate through the insulation jacket, with the teeth progressively wedging their way through the jacket and thereby gathering a substantial length of the conductor side margins into the progressively tapered clearances 14 and 12. This gathering action thereby causes the portions 32*b* and 34*b* to appear to bow or buckle outwardly of the center line 10, leaving the inwardly deformed portions 32*a* and 34*a* at a reduced localized area immediately adjacent the teeth 4 and 6. The gathering action thereby enhances the inherent resiliency of the conductor side margins to outwardly bow resiliently into the clearances between adjacent teeth. In addition, the gathering action of the wedged shaped teeth causes the portions 32*b* and 34*b* of the conductor side margins to be forcibly wedged into the clearances 12 and 14 between adjacent teeth. As shown in FIG. 7, the edges of the teeth 4 and 6 define relatively sharp corners or corner surfaces which slice through the insulation jacket to establish multiple points of contact with the conductor side margins 32 and 34.

Figure 3:
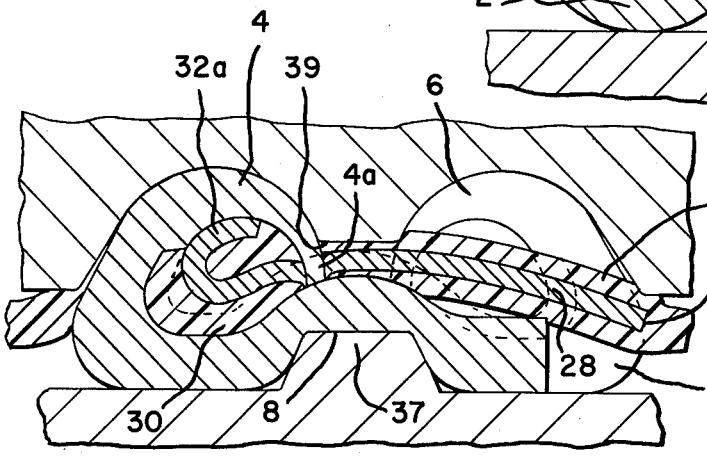
FIG. 3 is an enlarged elevation in section illustrating the component parts shown in FIG. 2 with the dies closed and with the terminal formed in crimped electrical connection to the conductor.
Figure 5:
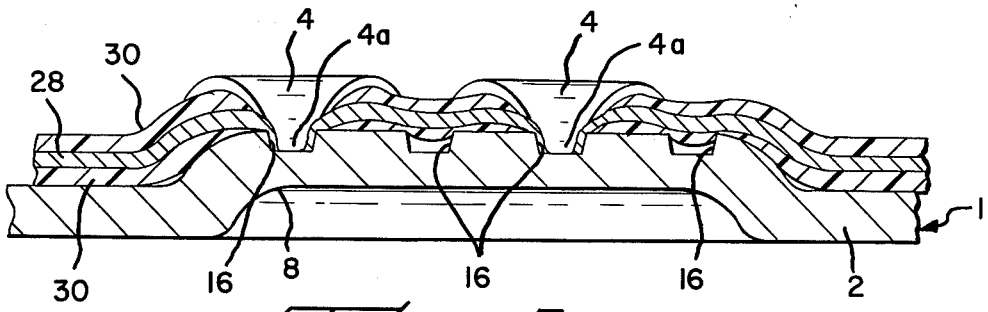
FIG. 5 is an enlarged fragmentary section taken along line 5—5 of FIG. 4.
Figure 6:
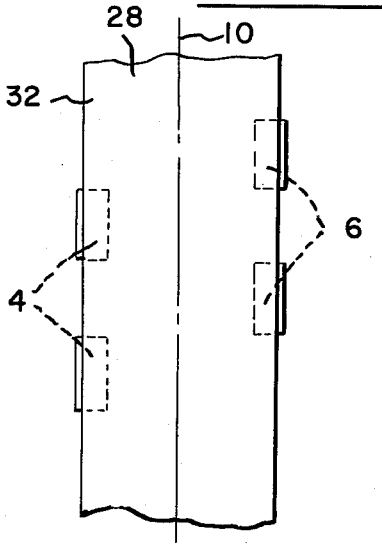
FIG. 6 is a diagramatic plan view of a flat conductor overlying an electrical terminal according to the present invention, prior to insertion of the conductor into the terminal and also prior to crimped electrical connection of the terminal to the conductor.

Also during insertion of the conductor 28 as described, the tooth tips 4*a* and 6*a*, after penetrating through the insulation jacket 30, will engage against the arcuate surfaces 26 of the die 22 as the dies 20 and 22 are progressively closed or displaced toward one another. Further closure of the dies causes the two tips to be cammed by the arcuate surfaces, first bending the teeth toward the teeth of one pair toward the teeth of the opposite pair and then bending the teeth toward the webbed portion 2. The arcuate surfaces curl the teeth also. Thus as shown in FIGS. 3, 4, and 5, the teeth are purposely bent to encircle the conductor 28, with the tooth tips 4a and 6a being curved or curled by the die surfaces 26 toward the conductor. The tips penetrate through the insulation jacket 30 to establish electrical contact with the conductor 28. In addition, the dies collapse the teeth 4 and 6 in encirclement over the conductor, the teeth pressing or pinching the conductor against the webbed portion 2. The pressure of the collapsed teeth 4 and 6 forces the insulation jacket 30 generally into the recessed channels or grooves 16 in the web portion 2, allowing the sharp corners of the webbed portion 2 which define the channels or grooves 16 to penetrate through the insulation jacket and electrically contact the conductor 28, further establishing multiple points of electrical contact between the terminal 1 and the conductor 28.

The teeth 4 and 6 are purposely staggered from the opposite pair such that as the teeth are curled toward one another and are collapsed in encirclement over the conductor 28, the tooth tips 4a and 6a will not engage or interfere with each other. This substantially reduces the amount of crimping pressure required to collapse the teeth in encirclement over the conductor, as compared to a condition whereby the teeth of the opposite pair will engage when curled over in encirclement. In addition, the staggered relationship permits at least one tooth tip 4a to be disposed adjacent to the clearance 14 defined between the teeth 6a of the opposite pair. The tooth tip 4a thus will press on the conductor 28 at a location immediately adjacent to the portion 34b of the conductor side margin 34, which is gathered into the clearance 14 defined between the teeth 6 of the opposite pair. The pressure of the tooth tip 4a thus tends to flatten the conductor, further wedging the gathered portion 34b into the tapered clearance 14 and thereby enhancing the electrical connection between the sharp corner surfaces or edges of the teeth 6 with the conductor side margins 34. In similar fashion, at least one of the tooth tips 6a is disposed adjacent to the clearance 12 which is defined between the adjacent teeth 4. The tooth tip 6a thus presses on the conductor 28 at a location adjacent to the portion 32b gathered in the clearance 12 between the adjacent teeth 4 of the opposite pair of teeth. The pressure of the tooth 6a thus tends to flatten the conductor 28 and forcibly wedges the gathered portion 32b of the conductor into engagement with the sharp corner edges or surfaces of the teeth 4 thereby enhancing the electrical connection of the teeth 4 on the conductor side margins 32.

It is the advantage of the terminal according to the present invention that it be specifically selected with an initial space between the opposed teeth 4 and 6 which is more narrow in distance than the width of the conductor to which the terminal is to be electrically connected. This will create purposely the inwardly deformed or pinched portions of the conductor side margins improving the mechanical grip of the teeth, on the conductor side margins and also providing sufficient gripping pressure such that the sharp corner surfaces or edges of the teeth will penetrate through the insulation jacket to establish multiple points of electrical contact with the inwardly pinched or deformed portions of the conductor side margins. In addition, the gathering action of the tapered teeth, the resiliency inherent in both the conductor and the overlying insulation jacket, acting together with the pressure of the tooth tips used to flatten the conductor, will force portions of the conductor side margins wedgingly into the clearance between adjacent teeth, with the sharp corner edges or surfaces of the teeth adjacent to and facing the clearance penetrating through the insulation jacket to establish multiple points of electrical connection with the gathered portions of the connector side margins.

The finished connection resists separation of the conductor from the positive and tenacious grip of the teeth on the inwardly deformed conductor side margins. In addition the resulting electrical connection is created by the contact of the teeth on the inwardly pinched or deformed connector side margins and on the additional portions of the conductor side margins wedged into clearances between adjacent teeth. Also the teeth tips penetrate the insulation jacket establishing additional points of electrical contact. Sufficient crimping pressure to establish the electrical connection is obtained without total reliance upon the amount of collapse of the terminal teeth in encirclement and in collapsed relationship over the conductor. Variations in thicknesses of the conductor 28 and the insulation jacket 30 will have little effect in varying the crimping pressure of the terminal on the conductor because of the reduced reliance upon the total collapse of the terminal to establish the desired electrical connection.

The projecting dimple portion 8 of the webbed portion 2 further provides a relatively elevated surface against which the tips 4a and 6a will press the conductor 28. The presence of the raised dimple portion 8 thus further reduces the amount of teeth collapse necessary to create the gripping pressure of the terminal to the conductor.

As shown in FIG. 3, the teeth also are curled to project the tips thereof normal to the surface of curvature of the dimple. In many instances of crimping, this is not always attainable. However if properly designed, the tooth tips will always have a tendancy to project normal to the surface of the dimple. This insures that sufficient crimping pressure is attained without a need to produce an inordinate amount of teeth collapse. In addition, as shown in FIG. 3, the dimple is supported by a projecting ridge 37 which is generally of trapezoidal cross-section and provided integral with the die 20. The ridge 37 prevents collapse of the dimple or embossment 8, when the dies are closed, as shown in FIG. 3, to curl the tooth tips into forcible compression on the embossment. The tooth tips are free-standing and are substantially unsupported by the die 22 as shown in FIG. 3. Thus there is the danger that the tooth tips will not curl completely to a desired configuration. Accordingly the embossment is supported in its elevated condition by the ridge 37 as the dies are closed to produce reaction pressure on the tooth tips when they are compressibly collapsed on the embossment. The tooth tips will therefore be compressed on the embossment and will also be compressed by the presence of the projecting die portion 39 at the intersection of the arcuate die surfaces 26. Although the portion 39 terminates in spaced relationship from the surface of the embossment 8, the tooth tips will be nonetheless sandwiched in compression between the die surfaces 26 and the embossment 8. Accordingly the presence of the raised embossment insures that the tooth tips are forced into compression against the web 2 of the terminal without an inordinate collapse of the teeth. As more particularly shown in FIGS. 3 and 5, the serrations 16 are positioned in the embossment 8 directly beneath corresponding teeth tips. When the dies are closed, the teeth will not only penetrate through the insulation layer 30 of the conductor but will also forcibly press portions of the conductor into the serrations. As shown in FIG. 5 the serrations are sufficiently wide to receive the teeth tips therein together with portions of the conductor 32. The insulation layer 30 covering the conductor 32 will be extruded or otherwise received into the serrations, permitting the corner edges of the serrations to penetrate through the insulation layer for intimate electrical contact with the conductor portions which are pressed into the serrations by the teeth tips. Accordingly the embossment 8 serves as an anvil to support the conductor, with the serrations across the surface of the anvil of the embossment serving to penetrate through the insulation for contact with certain portions of the conductor.

It is further emphasized that the serrations are advantageously formed by coining the terminals. Such coining operations not only produces the serrations with sharp corner edges but also work hardens the metal from which the terminal is made thereby stiffening the terminal. The stiffened terminal is thereby self-supporting and may be crimped around a conductor without substantial support around the terminal. The present invention thus discloses an electrical connector which is self-supporting, yet sufficiently thin enough to be crimped, simultaneously in large numbers, and collapsed into intimate encircling engagement over a conductor encased within a dielectric sheath or jacket.

FIGS. 8–11 illustrate a specific embodiment of the terminal as described. More specifically, a plurality of terminals 1 are illustrated with each having the web portion 2 and the teeth portions 4 and 6 thereon. Each web portion 2 is integral with a common carrier strip 36, and a integral electrical contact generally indicated at 38. In the preferred embodiment illustrated, the contact 38 is of a dual flanged receptacle configuration, although as previously described such a receptacle contact may be of any selected design adaptable for integral connection with the web portion 2 of the terminal.

Also as shown, if the terminals 1 and the terminal contacts 38 are to be stamped and formed integral with a continuous strip 36, it may be necessary to stack two carrier strips 36 on top of each other as illustrated in order to more closely space the terminal 1. Thus, the terminals 1 may be first stamped and formed at relatively wide distances from each other along a common carrier strip. By stacking at least two carrier strips together, the terminal may then be located or relatively closely spaced together placing the terminals of a second carrier strip in between terminals provided on the first carrier strip. Also as illustrated in FIGS. 8–11, the receptacle contact 38 may be received within corresponding cavities 40 within an insulation block 42. The block 42 includes a base portion 44 against which the terminals 1 are placed in abutment. The cavity is provided with a cover 46 attached integral with the housing 42 by a deformable plastic hinge 48.

As shown in FIG. 9, the terminal contact 38 can be inserted entirely with the cavities 40 with the teeth 4 and 6 of the terminal 1 being located against the base portion 44 of the housing 42 and in protruding relationship from the cavity 40. The common carrier strip portion 36 may then be removed as shown in FIG. 9, leaving the terminal 1 spaced from one another and inserted within corresponding cavities 40 of the housing 42.

As shown in FIG. 10, the cable 44 having the outer insulation jacket 30 and the plurality of individual flat configuration conductors 28 therein may be placed in overlying relationship with the terminal 1. A die 22 having a set of inverted acruated cam surfaces 26 may then be closed over the cable 44. The die 22 may be provided with the plurality of surfaces 26 to crimp a plurality of terminals 1 to the conductor 28 simultaneously upon the closure of the die 22. In the embodiment shown, the base portion 44 of the housing 42 serves as a replacement for or as a substitution for the other die 20 previously described in conjunction with FIGS. 2 through 7. Thus upon movement of the die 22 toward the base 44, the teeth of the individual terminals 1 will penetrate through the insulation jacket and will engage the die surfaces 26, causing the teeth to curl over and encircle the conductor 28 to provide a plurality of electrical connections simultaneously with each connection being of a configuration similar to that described in conjunction with FIGS. 1–7.

As shown in FIG. 10, the terminals are connected to a midportion of the cable 44 rather than to the edge 48 of the cable. It is to be understood however that the terminals 1 are designed to be crimped anywhere along the length of the cable 46. After the terminals are successfully crimped to the cable 46 with the individual terminals 1 in encirclement over corresponding conductors 28, the die 22 can be removed permitting the cover portion 45 to be pivoted about the hinge portion 47, thus closing the cover over the terminals 1 and enclosing the terminals 1 entirely with the housing 42. The cable 46 being flexible will be forced to bend back upon itself, providing a continuous unsevered midportion of the cable to enter and then to protrude from the housing 42.

If the terminals 1 are alternatively connected to the edge 48 of the cable, rather than the midportion of the cable, the cable edge 48 will terminate within the housing 42, with the terminal 1 being enclosed within the housing 42 upon closing the cover. Accordingly the present invention contemplates crimping either a single or plurality of terminals to corresponding conductors of a flat flexible electrical cable. The terminals may be connected to the cable and remain exposed. Additionally, the exposed terminals may be first connected to the conductors of the flat and flexible electrical cable, and then may be inserted internally of a housing (not shown). Alternatively, the terminals may be contained within an insulation housing prior to crimping, with the terminals subsequently connected to the conductors of the flat and flexible cable as described with reference to FIGS. 8–11. When a plurality of terminals are connected to corresponding conductors, such terminals may be connected simultaneously, since the terminals may be fabricated from relatively thin stock material, with the deformation of the terminals being restricted to the wedged shaped teeth portions, which minimizes the amount of metal of the terminals which need be deformed to establish the electrical connection.

Although specific embodiments and modifications of the present invention are illustrated and described in detail, other modifications and embodiments which would be apparent and obvious to one having ordinary skill in the art are intended to be covered by the spirit and scope of the appended claims.

What is claimed is:

1. An electrical terminal adapted to grip opposite side margins of an elongated flat configuration conductor, the terminal comprising:

a web portion, a first pair of teeth extending from said web portion of the conductor for inwardly deforming one side margin of the conductor in two places along the length of the conductor, a second pair of teeth extending from said web portion, for inwardly deforming another side margin of the conductor in two places along the length of the conductor, said first pair of teeth defining a clearance therebetween for receiving therein a portion of one side margin of the conductor which lies between the inwardly deformed two places of the conductor, said second pair of teeth defining a clearance therebetween for receiving therein a portion of another side margin of the conductor which lies between the inwardly deformed two places of the conductor, said teeth of each pair being deformable toward said web to pinch said conductor against said web, said first pair of teeth being offset from said second pair of teeth longitudinally along the length of the web, with at least one of the teeth of each pair disposed across said web opposite the clearances between the teeth of the opposite pair so at least one of the teeth of each pair will pinch the conductor against said web and thereby tend to press the conductor into wedged relationship into the clearance between the teeth of the opposite pair.

2. The connection as recited in claim 1, and further wherein, said teeth penetrate the insulation jacket at the inwardly pinched and deformed portions of the conductor side margins to establish electrical contact of the teeth with said side margins, and the edge surfaces of adjacent teeth of each pair being sharp and penetrating through the insulation jacket and in electrical contact with the portions of the side margins which are wedged between the adjacent teeth.

3. The connection as recited in claim 1, wherein the adjacent teeth of each pair are substantially tapered to define a tapered clearance therebetween with portions of the conductor side margins wedged into each of the tapered clearances between adjacent teeth, and with said teeth having sharp edges facing the clearances between the adjacent teeth which penetrate the insulation jacket on said conductor portions that are wedged into said clearances to establish electrical contact therewith.

4. A terminal for connection to a conductor of elongated and flat configuration, comprising:

a web portion, each side of said web portion provided with a pair of projecting teeth which are bent outwardly from said body portion to define two rows of teeth, each pair of teeth defining therebetween a progressively narrowing notch for wedged receipt therein of a side margin of a conductor of elongated and flat configuration, the pair of teeth on one side of the web being offset with respect to the teeth on the other side of the web, with the notches between each pair of teeth thereby being offset from each other, the first pair of teeth being initially spaced from the other pair of teeth by a width less than the width than the conductor to which the terminal is to be attached to permit forcible insertion of the conductor initially into said clearance while portions of the side margins of the conductor are inwardly pinched adjacent each of said teeth, said teeth being deformable toward the teeth of the opposite pair and then toward the base to force the tips of said teeth into engagement on the conductor pinching the conductor against the web portion and to force the side margins of the conductor into the progressively narrow notches, the edges of said teeth adjacent said notches being substantially sharpened to penetrate the insulation jacket on the conductor and to establish electrical contact with the conductor.

5. An electrical terminal intended for electrical connection to an elongated conductor of the type having a flat configuration and two longitudinal side margins extending the length of the conductor, said terminal comprising:

a web portion having a first pair of teeth projecting from one side of the web portion, and a second pair of teeth projecting from an opposite side of the web portion, each pair of teeth being bent out of plane of the web portion to define a space initially separating the first pair of teeth from the other pair of teeth, said space being initially less than the width between the longitudinal side margins of the conductor to which the terminal is to be connected such that upon forcible insertion of the conductor into said space, portions of the conductor side margins at corresponding locations immediately adjacent the teeth become pinched inwardly toward the longitudinal center axis of the conductor while substantially unpinched portions of the conductor side margin are forcibly wedged between the teeth of each pair, and subsequent to insertion of the conductor into the space between the opposed pairs of teeth said teeth being capable of deformation toward the teeth of the opposite pair and then toward said web portion to pinch the conductor against the web portion, the free ends of the teeth being sharpened for penetrating through the insulation jacket of the conductor to establish electrical contact between the teeth of the terminal and the conductor, the teeth of each pair having sharpened edges for piercing through the insulation jacket of the conductor to establish electrical contact of the teeth of each pair with the conductor side margin portions which are forcibly wedged between the teeth of each pair.

6. The structure as recited in claim 5, wherein the adjacent teeth of each pair are tapered to define therebetween a converging wedge-shaped clearance into which said substantially unpinched conductor side margins are forcibly wedged.

7. An electrical terminal intended for electrical connection to an elongated conductor of the type having a flat configuration and longitudinal side margins extending the length of the conductor, the terminal comprising:

a web, a first pair of teeth projecting from one side of the web and defining a clearance between the first pair of teeth, a second pair of teeth projecting from a second side of the web with the second pair of teeth defining therebetween a second clearance, each pair of teeth being deformable into curled relationship over said web to grip the conductor between said web and each of said teeth, each pair of teeth being deformable into curled relationship over the side margins of said conductor to inwardly deform corresponding portions of said side margins of the conductor and to outwardly buckle said conductor side margins into the clearance defined between said each pair of teeth, and said teeth further being deformable toward said base to penetrate the teeth into the insulation jacket of the conductor to establish electrical contact between the conductor and the teeth and further to pinch the conductor against said base and compressibly pinch the teeth onto the curled over side margins of the conductor and to force the outwardly buckled portions of the conductor into the clearances between the pairs of teeth.

8. An electrical terminal adapted to be connected in gripped relationship with a flat elongated conductor, comprising:

a web portion having a first pair of teeth projecting from one side of said web portion and a second pair of teeth projecting from an opposite side of said web portion, each of said pairs of teeth being bent outwardly of the plane of said web portion and defining an initial space separating said first and second pairs of teeth, each of said teeth being wedge-shaped and defining wedged-shaped clearances between adjacent teeth, each of said teeth having sharp slicing edges adjacent corresponding wedge-shaped clearances, each of said teeth having a rounded and sharpened tip, and each of said teeth being chamfered to allow curling thereof upon deflection of said teeth tips toward said web portion pinching a flat elongated conductor between said teeth tips and said web portion.

9. The structure as recited in claim 8, and further wherein, said web portion includes a raised embossment portion against which a flat elongated conductor is pinched by said teeth.

10. The structure as recited in claim 9, and further wherein, said web portion includes a channel in alignment with each of said teeth with sharp corners of said web defining each channel.

11. The structure as recited in claim 10, wherein, said teeth of said first pair are offset longitudinally with respect to said teeth of said second pair.

* * * * *